US005568786A

United States Patent [19]

Lynch et al.

[11] Patent Number: 5,568,786

[45] Date of Patent: Oct. 29, 1996

[54] CHECKMATE COMMUNICATION SYSTEM

[76] Inventors: Patrick J. Lynch, 104 Whitman Ave., Islip, N.Y. 11751; Eugene Charles, 306 11th St., Huntington Beach, Calif. 92648

[21] Appl. No.: 377,860

[22] Filed: Jan. 25, 1995

[51] Int. Cl.[6] ..... G08B 5/00

[52] U.S. Cl. ..... 116/303

[58] Field of Search ..... 116/303, 284, 116/179, 175

[56] References Cited

U.S. PATENT DOCUMENTS

| | | | |
|---|---|---|---|
| 3,848,244 | 11/1974 | Young et al. | 116/303 X |

FOREIGN PATENT DOCUMENTS

| | | | |
|---|---|---|---|
| 678078 | 3/1930 | France | 116/303 |
| 166503 | 12/1905 | Germany | 116/303 |
| 82171 | 3/1919 | Switzerland | 116/303 |
| 2187875 | 9/1987 | United Kingdom | 116/284 |

*Primary Examiner*—William A. Cuchlinski, Jr.
*Assistant Examiner*—Willie Morris Worth

[57] ABSTRACT

This specification discloses a communication device used by a patron to gain the attention of a host in the food service industry. A clip is used to clip onto a conventional check-holder (not shown) . Adhered to the clip is a platform which acts as a base. On one end of the platform will be a release latch spring and release latch button working in conjunction with a disc rotate pin and a disc rotate spring which will enable the proper oscillation of the disc. The disc will rotate from a parallel position to the platform when closed to a vertical position to the platform when opened. The rotation of this disc will notify the host from a distance that the patron is in need of service. Once the patron has been accommodated the host can return the disc to its normally closed position which is parallel to the platform. The disc will stay in its normally closed position by way of a machined coupling device that will lock into the release latch spring, release latch button, and machined multi-ported cavity until needed again.

1 Claim, 2 Drawing Sheets

CHECKMATE COMMUNICATION SYSTEM

FIELD OF THE INVENTION

This invention relates generally to the restaurant and food service industry and more particularly to an appliance for improving the ways of communication between the host and the patron during a dining experience.

BACKGROUND OF THE INVENTION

Many of the finer restaurants and food service establishments around the world use check holders, also known as billfolds or checkbinders etc., to present the bill due to the customer at the end of his/her dining experience. At present in order for the host to know if the patron is ready to pay for his/her services the host must periodically ask the patron if they have finished which in some instances can be quite invading as well as disturbing. Another way in which the server knows the patron is ready to pay for their services is when the patron must look for the appropriate server and attempt to gain their attention, which tends to ruin the dining experience whether it be business or pleasure. The Checkmate Communication System completely eliminates these inconveniences to enable the patron to enjoy a more relaxing dining atmosphere.

SUMMARY OF THE INVENTION

The present invention overcomes some or all of the shortcomings of the poor communication between the host and the patron such that the Checkmate Communication System will virtually eliminate the need for the server and patron to needlessly look for assistance.

The Checkmate Communication System is a link between the patron and the server that makes for a much more private, peaceful and romantic atmosphere for the patron. The server greatly benefits from the Checkmate Communication Systems in that he or she can dedicate more time to those patrons who need it and give those patrons who don't the privacy and comfort they deserve. Even the proprietor or proprietress of the establishment will benefit, in that they know that their patrons are being accommodated properly so that they may enjoy their dining experience, furthermore, this will enhance the patron's future business dealings with the establishment. Further aspects and advantages of the invention will become apparent from a consideration of the drawings and ensuing description.

DETAILED DESCRIPTION OF A PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps in constructing and operating the invention in connection with the illustrated embodiments. It is understood however, that the same or equivalent functions and sequences may be accomplished by different embodiments, that also are intended to be encompassed within the spirit and scope of the invention.

Figure 2:
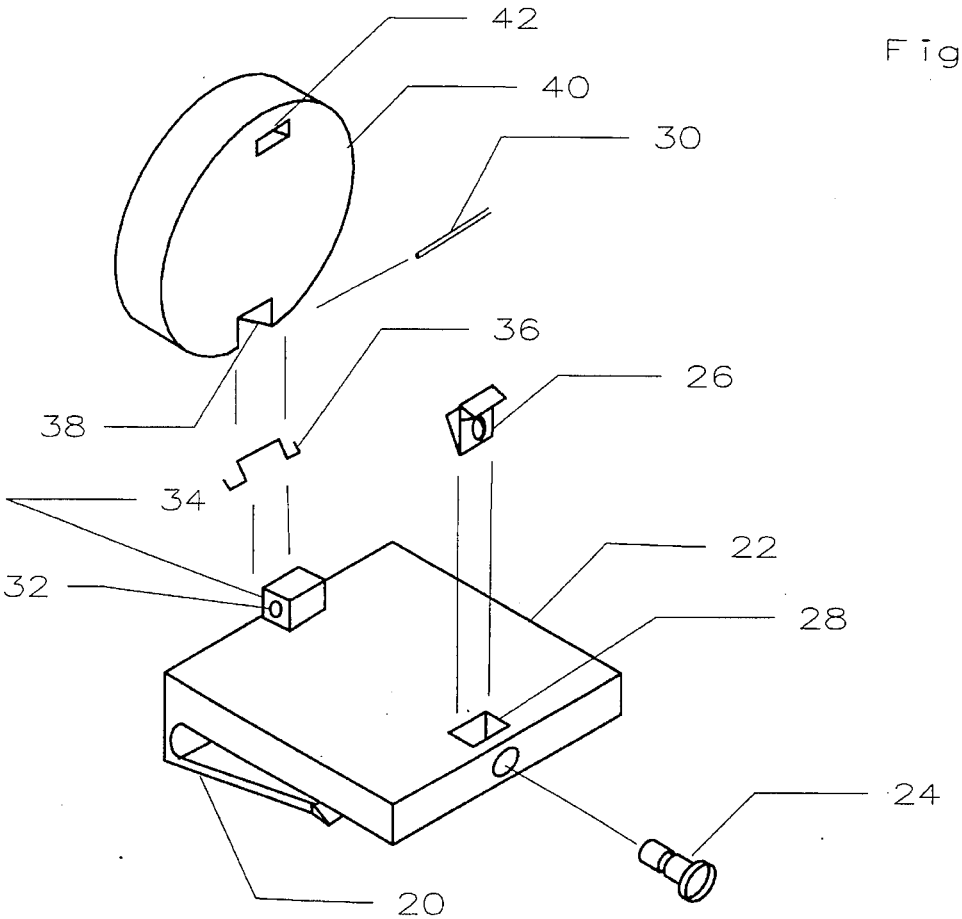
FIG. 2 is a perspective view of the interconnection of the parts to the Checkmate Communication System.

The structure and function of the present invention can best be understood by first examining the structure of the Communication device in FIG. 2, which provides a perspective view of the interconnection of the parts in the Checkmate Communication System. Referring to FIG. 2, a clipping or clasping device 20 which configured in such a way that clip 20 will be able to fasten onto various thickness' of conventional billfolds, checkbinders/checkholders (not shown) as well as be able to be released from such items. Clip 20 is formed from a material such as; gold, silver, brass, copper, or nickel. However, clip 20 can consist of any other material that can be repeatedly bent without fracturing such as polyethelene, polypropelene and other such materials. Adhered to clip 20 will be a platform 22 which will act as a base for the retention and oscillation of a disc 40.

Platform 22 will be adhered to clip 20 by means of solder, spot-weld or arcweld but not necessarily be limited to this kind of adherence. Platform 22 as well as disc 40 may be constructed using any of the above mentioned materials used in the composition of clip 20. One end of the platform 22 will be machined protrusion 34 with a machined lateral hole 32 positioned towards the top portion of the protrusion 34, this will enable disc 40 to oscillate in conjunction with a disc rotate pin 30 and a disc rotate spring 36. Disc 40 will conform with platform 22 by way of a machined multiported notch 38 communicating with protrusion 34. Directly opposite protrusion 34 on platform 22 will be a machined multiported cavity 28 which will act as a clutch in conjuntion with a release latch button 24 and a release latch spring 26. Release latch button 24 and release latch spring 26 in conjunction with multi-ported cavity 28 will be installed in such a way as to aid in the retention and oscillation of disc 40. Directly opposite multi-ported notch 38 on disc 40 will be a machined coupling device 42 which will communicate with release latch button 24, release latch spring 26 and machined multi-ported cavity 28. Disc rotate pin 30 will reside in lateral hole 32 towards the top portion of protrusion 34 on platform 22, disc rotate spring 36 will be installed in such a way as to allow for the constant predetermined pressure to hold disc 40 in it's erect position as seen in FIG. 4, in conjunction with disc rotate pin 30, machined lateral hole 32 machined protrusion 34, and machined multi-ported notch 38.

Figure 1:
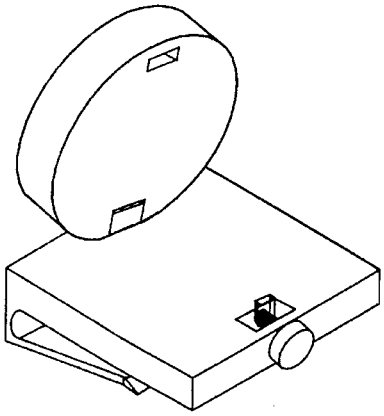
FIG. 1 is a perspective view of the complete Checkmate Communication System connected to their respective parts.
Figure 5:
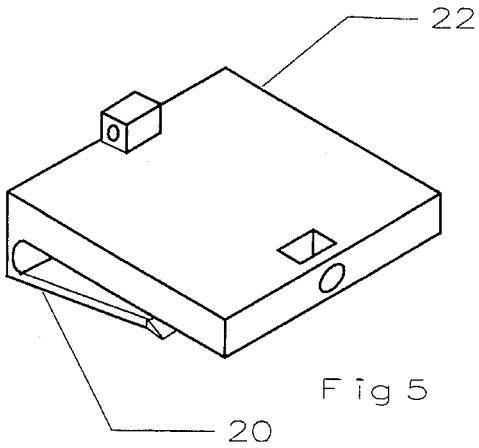
FIG. 5 shows a perspective view of the clip assembly 20.
Figure 6:
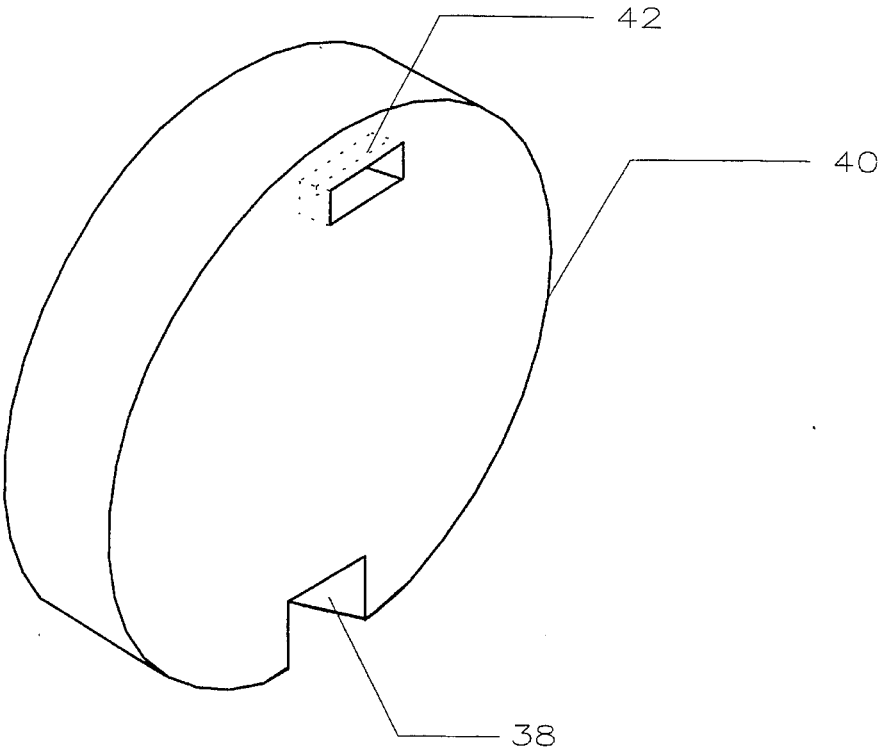
FIG. 6 is a perspective view of Disc 40, showing the machined coupling device 42 and machined multi-ported notch 38.
Figure 3:
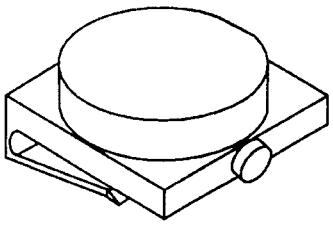
FIG. 3 is a perspective view of the Checkmate in it's normally closed position.
Figure 4:
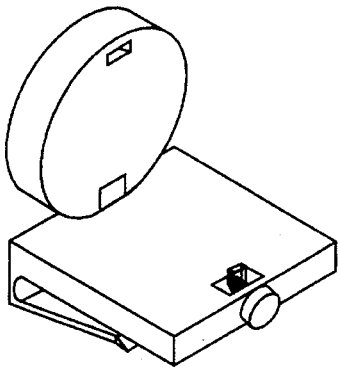
FIG. 4 is a perspective view of the Checkmate in it's erect position.

Coupling device 42 will work in such a way as to hold disc 40 in it's normally closed position, as seen in FIG. 3, until needed to oscillate to it's erect position, as seen in FIG. 4. Once triggered, disc 40 can be returned to it's normally closed position (parallel to platform 22) by physically pushing downward on disc 40 so that coupling device 42 communicates with release latch button 24, release latch spring 26, and multi-ported cavity 28 until need again.

| Reference numerals in Drawings | | | |
|---|---|---|---|
| 20 | Clip | 22 | Platform |
| 24 | Release Latch Button | 26 | Release Latch Spring |
| 28 | Machined multi-ported Cavity | 30 | Disc Rotate Pin |
| 32 | Machined Lateral Hole | 34 | Machined Protrusion |
| 36 | Disc Rotate Spring | 38 | Machined Multi-ported Notch |
| 40 | Disc | 42 | Machined Coupling Device |

OPERATION OF THE PREFERRED EMBODIMENT

The Checkmate Communication System will operate in such a way that a waiter/waitress will present the Checkmate at the beginning or the end of the dining encounter, with it clipped onto the conventional checkholder (not shown). As previously discussed clip 20 will be clipping onto the conventional checkholder (not shown). Attached to clip 20; will be platform 22 which will act as the base of the communication device. Release latch button 24 and release latch spring 26 in conjunction with machined multi-ported cavity 28 will work in such a way to enable the retention and oscillation of disc 40. Disc 40 will remain at a normally closed or retained (position) (parallel to platform 22) by way of machined coupling device 42 that will communicate with release latch button 24, release latch spring 26 and machined multi-ported cavity 28. Release latch button 24 and release latch spring 26 in conjunction with machined multi-ported cavity 28 will keep disc 40 in either it's normally closed position which will be parallel to platform 22, or it's fully erected position which is vertical to platform 22 when triggered. Disc 40 will conform with platform 22 by way of machined multi-ported notch 38 communicating with machined protrusion 34. In order for disc 40 to rotate from it's closed position (parallel to platform 22) to it's open position (vertical to platform 22) disc 40 will utilize disc retainer pin 30 residing in machined lateral hole 32 in conjunction with machined protrusion 34 to rotate up and down and also disc rotate spring 36 to keep disc 40 in it's erect position. Disc 40 will remain in it's normally closed position by way of a machined coupling device 42 which communicates with release latch button 24, release latch spring 26 and machined multi-ported cavity 28.

Once triggered by release latch button 24 and release latch spring 26 disc 40 will oscillate to it's vertical position to platform 22 and visually notify a waiter/waitress that a patron is in need of assistance. Once the patron is helped, the waiter/waitress will reset disc 40 to it's normally closed position, (parallel to platform 22) by way of a machined coupling device 42 on disc 40 that will be held by release latch button 24, release latch spring 26 and Multi-ported cavity 28 until needed again. Thus the reader will see that the Checkmate Communication System provides a very comfortable and relaxing environment for people dining for privacy or pleasure, in business and for fun, the patron knows that when he/she needs assistance it will be right at their fingertips.

Although the description above contains many specifities, these should not be constructed as limiting the scope of the invention, but, as merely providing illustrations of some of the presently preferred embodiments of this invention. For example, the clip can be constructed to clip on to the side of a table, it can also be constructed to clip onto a money tray, the adhesion of the clip to the platform can be made with jeweler type screws and screwed into the body of the platform. The rotating disc can be rectangular as well as cylindrical, etc.

Accordingly the scope of the invention should be determined by the appended claims and their legal equivalents, rather than by the examples given.

What is claimed is:

1. A communications device comprising:

a clipping or clasping device having the flexibility to clasp onto various thickness' of materials;

a visual attractant for obtain the attention of humans;

a platform having a pre-determined cross-sectional shape used as a base for pivotally mounting said visual attractant;

means for adhering said platform to said clipping or clasping device;

means for pivotally mounting said visual attractant to said platform;

constant pressure means mounted between said visual attractant and said platform for biasing said visual attractant toward an erect position;

latch means on said platform for releasably retaining said visual attractant in a closed position; and coupling means on said visual attractant for cooperating with said latch means to releasably retain said visual attractant in said closed position.

* * * * *